US008905568B2

(12) United States Patent
Fossier et al.

(10) Patent No.: US 8,905,568 B2
(45) Date of Patent: Dec. 9, 2014

(54) FORKLIFT ACTIVATED MIRROR ALERT

(76) Inventors: David A. Fossier, Cincinnati, OH (US); William Chernick, Cincinnati, OH (US)

( * ) Notice: Subject to any disclaimer, the term of this patent is extended or adjusted under 35 U.S.C. 154(b) by 213 days.

(21) Appl. No.: 13/178,684

(22) Filed: Jul. 8, 2011

(65) Prior Publication Data

US 2011/0260888 A1 Oct. 27, 2011

Related U.S. Application Data

(63) Continuation-in-part of application No. 11/437,093, filed on May 19, 2006, now abandoned.

(60) Provisional application No. 60/685,516, filed on May 27, 2005.

(51) Int. Cl.

| | |
|---|---|
| ***F21V 33/00*** | (2006.01) |
| ***G09F 13/12*** | (2006.01) |
| ***G09F 9/33*** | (2006.01) |

(52) U.S. Cl.

CPC *G09F 9/33* (2013.01); *G09F 13/12* (2013.01); *Y10S 362/802* (2013.01); *Y10S 362/812* (2013.01)

USPC ..... 362/135; 362/540; 362/542; 362/802; 362/812

(58) Field of Classification Search

USPC ..... 362/459–549, 135–144, 802, 812

See application file for complete search history.

(56) References Cited

U.S. PATENT DOCUMENTS

| | | | | |
|---|---|---|---|---|
| 5,572,202 | A * | 11/1996 | Regel et al. | 340/917 |
| 2002/0175825 | A1* | 11/2002 | Clerk et al. | 340/686.6 |
| 2006/0071766 | A1* | 4/2006 | O'Brien et al. | 340/442 |
| 2006/0133072 | A1* | 6/2006 | Leyden et al. | 362/135 |

* cited by examiner

*Primary Examiner* — William Carter

(74) *Attorney, Agent, or Firm* — John B. Woodard; Jon L. Woodard; Woodard International Law

(57) ABSTRACT

A partially transparent dome mirror is used to display messages generated from within the dome by a light generating system. The mirror is incorporated in an apparatus for seeing and warning traffic crossing at an intersection in a commercial, industrial or other space to improve worker safety and to avoid costly damage due to collisions at the intersection. The unitary apparatus does not require sensors or other wiring external to the mirror and its supporting frame. The mirror system can also be used in commercial and retail applications for surveillance and advertising.

21 Claims, 3 Drawing Sheets

FORKLIFT ACTIVATED MIRROR ALERT

CROSS REFERENCE TO RELATED APPLICATIONS

This is a continuation-in-part application of U.S. patent application Ser. No. 11/437,093, filed May 19, 2006 now abandoned, which is hereby incorporated by reference and which claims the benefit of U.S. Provisional Patent Application No. 60/685,516 filed May 27, 2005.

BACKGROUND OF THE INVENTION

When forklifts are used in an industrial environment such as a factory or a warehouse situation, they usually occupy a space that is populated not only with forklifts but with other moving things as well. These can comprise a wide variety of moving objects such as powered and unpowered utility carts, bicycles, golf carts and even people. Wherever there are moving objects such as these, there is always a danger of collision between them. Particularly severe collisions can happen when the moving objects are massive, such as when forklifts collide, and even lethal damage can occur if a person is involved in a collision.

The danger of collisions is manifest at intersections on a factory or warehouse floor, especially, when views are inhibited by items adjacent the intersections that obscure oncoming traffic approaching the intersections.

Prior art for warning of or seeing approaching traffic at intersections has included traffic signals, various mirror arrangements for observing traffic, floor embedded sensors for triggering warnings, auditory warning systems, and sensors distributed around the areas of approach to intersections. These have been used to trigger various warning devices from signs to whistles.

Installation of these systems is often expensive and time consuming. The installation usually requires significant wiring over a plurality of approaches and a central control unit with the wiring often subject to damage in the industrial environment. In addition the distributed sensors on which they depend are easily blocked or damaged due to their distribution around the area of the intersection with some of them necessarily disposed at low levels where they can easily be hit or damaged by activities occurring in the industrial environment.

A reliable and robust apparatus for detecting and warning of the presence of traffic that approaches the intersection outside the line of sight of one approaching the intersection is needed. This system should be able to detect and distinguish between the kind of traffic that is approaching the intersection, the sizes of objects approaching the intersection and various properties of the objects approaching such as speed and composition. The apparatus should further be able to distinguish whether the traffic is approaching or departing the intersection. The apparatus should then be able to warn of the approach of objects that might be out of the line of sight of one approaching the intersection and designate the positions of the other approaching traffic.

Further, the apparatus should be easily installable requiring little time or skill on the part of the installer. Most desirable would be a single integrated unit not requiring the disposition of various parts of the apparatus about the intersection. Particularly, extensive on-site wiring of detectors sensors and the like should be avoided.

The apparatus should offer direct visual identification of the traffic approaching the intersection. This would be best accomplished by providing an image of the approaching traffic in addition to a warning even if the intersection comprises acute, right, or obtuse angles between intersecting pathways.

Those who routinely work in or manage an industrial situation where traffic must pass through intersections will recognize that such improvements in intersection warning systems are needed.

BRIEF DESCRIPTION OF THE INVENTION

An apparatus for seeing and for warning of traffic crossing at an intersection is provided. The apparatus comprises a partially transparent dome mirror with an outside surface for reflecting incident light and an inside surface that receives light from inside the dome of the mirror and passes the light through the mirror.

A light producing system is used for illuminating the inner surface and transmitting light through the mirror so that the light is visible when viewing the outside surface. The light producing system is capable of displaying messages through the mirror for viewing from outside the mirror.

In addition a sensing system is used for identifying traffic crossing at the intersection. The sensing system is in communication with the light producing system and causes the light producing system to provide messages visible when viewing the outside surface of the mirror.

Further, an apparatus for seeing and warning traffic crossing at an intersection is provided which has a partially transparent mirror with a first side for reflecting incident light and a second side for receiving and passing light through the mirror. The second side is illuminated by a light producing system which passes the illuminating light through the mirror so that the light is visible when looking at the first side. The light producing system is capable of displaying messages through the mirror for viewing from the first side of the mirror.

Also, a sensing system is used for identifying traffic crossing at the intersection. The sensing system can distinguish among the following: substantially metallic objects, substantially non-metallic objects, sizes of approaching objects and whether traffic is approaching the mirror or departing the mirror. The sensing system communicates with the light producing system causing the light producing system to provide appropriate warning messages visible when viewing the first side of the mirror. The warning messages are provided by the light producing system and are dependent on the nature of the approaching traffic.

The apparatus is capable of discriminating traffic approaching the mirror from at least one direction and displaying a message through the mirror in at least one other direction to warn about the traffic approaching the mirror. A reflection of approaching traffic can be seen from the first side of the mirror. The apparatus is also capable of displaying messages warning of the approach of traffic from multiple directions simultaneously.

An apparatus for surveillance and advertising in commercial environments is provided having a partially transparent dome mirror with a first side for reflecting incident light and a second side for receiving and passing light from inside the dome through the mirror. The apparatus further comprises a light producing system for illuminating the second side from inside the dome mirror and passing light through the mirror so that the light is visible when viewing the first side. This light producing system can display images through the mirror for viewing from outside the mirror. A sensing system for identifying the approach of a customer toward the mirror is provided. The sensing system communicates with the light producing system causing the light producing system to provide images visible when viewing the first side of the mirror. The apparatus can sense customer traffic approaching the mirror and can display a message through the mirror that can be used for advertising purposes and for alerting purposes. A reflection image is visible in the first side of the mirror caused by the exterior light incident on the mirror.

DETAILED DESCRIPTION OF THE INVENTION

Figure 1:
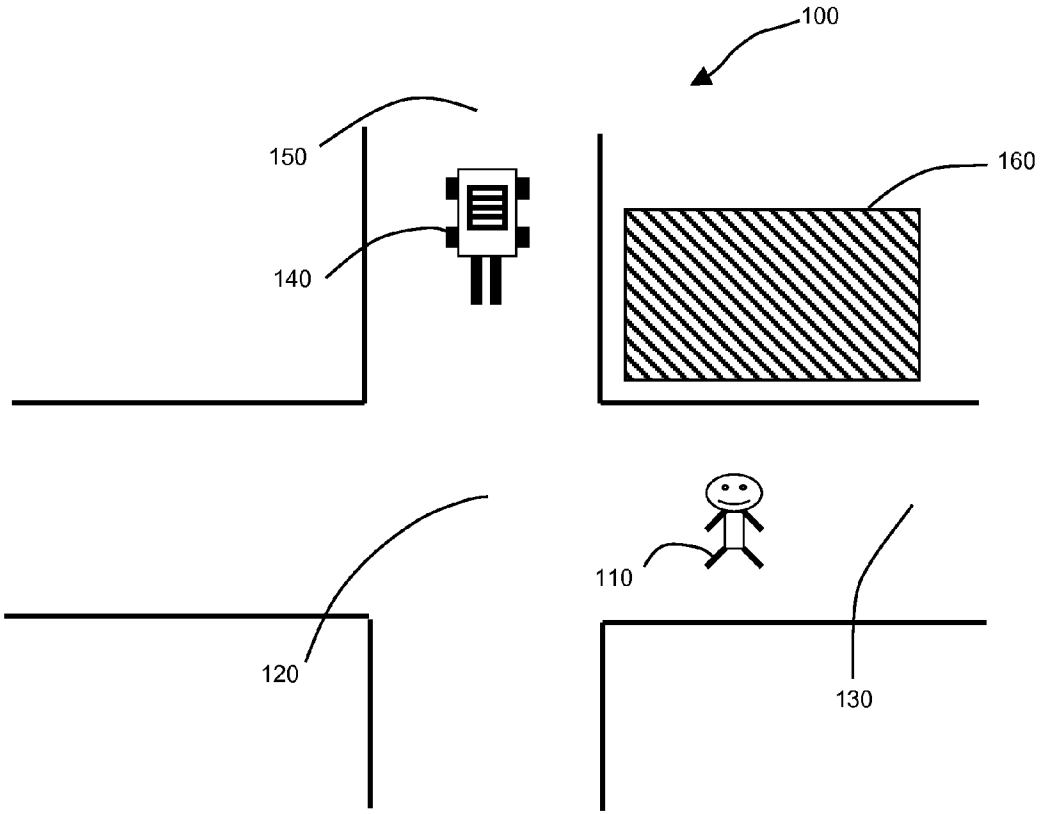
FIG. 1 is a four way intersection.

An apparatus for seeing and warning traffic crossing at an intersection in a commercial, industrial or other space is used to improve worker safety and to avoid costly damage due to collisions at the intersection. For example, the apparatus could be used in a factory or warehouse with the effect of not only avoiding personal injury or property damage, but, also to have the effect of significant cost savings in premiums for insurances such as physical damage insurance or workers' compensation insurance. The invention is concerned with systems that warn people approaching an intersection of the approach of other traffic that might not be seen as the one approaches the intersection.

Along with preventing accidents in the general movement of individuals walking or using other means of conveyance, the invention works to avoid collisions involving forklifts or any kind of motorized industrial truck that, when in use, sometimes limit the vision of their operators leading to safety issues of operation and requiring extensive education of their operators to preserve safety and comply with federal law.

The apparatus can provide images of traffic approaching an intersection, an optically presented warning message regarding the other traffic's approach, an auditory warning, an identification of the nature of the traffic approaching, other data regarding the approaching traffic such as speed, dimension, and composition, whether the traffic is approaching or departing, handle multiple approaching traffic simultaneously, and using an appropriate logic system adjust the message presented as desired to maximize safety at the intersection.

The apparatus is an integrated unitary package in which all the elements comprising the apparatus are disposed adjacent one another, attached together by a frame that supports all the elements in a single mountable unit intended to occupy a central position in the intersection. The unitary package, comprising the entire apparatus, is designed for ease of installation by untrained personnel with the provision of power to the unitary apparatus as the only wiring requirement.

The apparatus comprises a partially transparent mirror that can present a curved outer surface or a plurality of surfaces of different or equal curvatures. The mirror is usually constructed to insure that one side of the mirror, often called the front side of the mirror, is highly reflective. Further, the mirror is designed to reflect light incident on the outside of the mirror to the extent possible, but in most cases will allow part of the light to pass through the mirror by virtue of its transparency. The other side of the mirror, often called the backside, can be reflective but is designed to allow light incident thereon to be transmitted through the mirror passing through the front side of the mirror.

One embodiment of this is a spherical dome, sometimes referred to mathematically as a spherical segment, which can be interpreted as a segment of a sphere and can be defined by the spherical radius of the sphere of which the mirror is a segment. To be structurally viable the mirror must have some thickness. When the mirror is of uniform thickness, the mirror segment can be defined by either its inner or outer radius combined with the thickness of the mirror.

As described above, the dome mirror is partially transparent with the outer surface of the mirror intended to be highly reflective to provide images visible in the mirrored surface of objects disposed about the mirror.

The inner surface of the mirror, defined by the inner radius of the mirror, is intended to receive light from inside the mirror and transmit the light through the partially transparent mirror such that the source of the light is visible outside the mirror. Alternatively, the light can impinge on a coated surface or on an activatable surface such as a phosphor coating on the mirror to make the light appear when viewed outside the outer surface of the mirror to emanate from the outer surface of the mirror.

In some cases the dome mirror can be a segment of a distorted sphere, which is not strictly defined by a constant radius.

A light producing system is disposed within the inside of the mirror. The light producing system is intended to provide messages that can be read from outside the mirror and that are easily visible from outside the mirror.

Various sources can be used to create the light inside the dome of the mirror. For example, a display of light emitting diodes could be used to display an image such as a message via symbols and/or letters that would be visible from outside the mirror.

Another source, a laser, could be used to excite a coated outer surface of the mirror thus effectively providing an image on it.

From another aspect a light source could be interrupted by a graphical overlay or series of overlays causing an image to appear from inside the mirror.

In all of these methods of providing light the viewer outside the mirror is precluded from seeing the apparatus inside the mirror by the high ambient light reflectivity from the outer surface of the mirror and will only see the relatively bright light emitted by the light source within the dome or generally inside the apparatus. In this way the mirror will appear to have a message written on it.

A sensing system is employed as a part of the apparatus for identifying traffic that approaches and/or departs the intersection. This sensing system can comprise a variety of sensor technologies for identifying the nature of the approaching traffic. Some technologies that can be employed for this are: microwave, photo sensors, magnetic loop, radio frequency, acoustic, radar, and laser.

Other sensor technologies could also be employed. The sensor system used must be able to distinguish the nature of the objects approaching the intersection.

The system should be able to differentiate between substantially metal objects and substantially non-metal objects. Such ability is valuable in distinguishing people from machines.

In addition the system should be able to distinguish the sizes of approaching objects. For example, the system should be able to distinguish among the sizes of a person, a bicycle, a golf cart, a service vehicle, sometimes called a "cushman," a powered industrial truck which is sometimes a forklift, and a scooter.

Further, the sensing system should also be able to determine whether an object is approaching or departing the intersection so that approaching traffic is not confused with departing traffic. Such confusion can lead to incorrect indications by the system and could lead to unwanted warnings regarding traffic in the vicinity of the intersection.

Once the sensing system has identified approaching traffic and the nature of the traffic, a message warning of the traffic and its nature can be displayed by the light producing system through the mirror. This message is displayed in a direction or directions other than the direction from which the sensed traffic is approaching to make traffic approaching from the other directions aware of the presence of the traffic approaching from the original direction.

In like manner the other traffic approaching the intersection will also be sensed and identified by the sensing system and corresponding messages will be shown in directions other than the direction of approach.

For example consider the crossing situation 100 in FIG. 1. If a person 110 is walking toward the intersection 120 along pathway 130 and a forklift 140 is approaching the intersection 120 from another direction along pathway 150 in a situation where the view of the person 110 and the forklift 140 operator is blocked by a view blocker 160 such as a stack of material, the apparatus will need to identify both the person 110 and the forklift 140 and will need to display messages to the person 110 and the forklift 140 operator warning of the presence of the other.

Of course, the system can be arranged to display warning messages in any set of different directions to satisfy safety requirements of the specific intersection being encountered by traffic.

FIG. 1 shows a simple crossing intersection 120, but an intersection could be much more complicated possibly having many additional directions of approach, and the apparatus could be configured to display warning messages in all or any particular needed subset of directions. The intersection could even have traffic arriving from different levels, such as, for example, an intersection involving arrival from ramps intersecting at the intersection.

Similarly, the intersection could have fewer directions of approach than in FIG. 1. However, warnings could still be needed. In such cases the apparatus can be adjusted accordingly.

In some cases the system can be designed not to display a message even though the system has detected and identified the nature of oncoming traffic. For example, the system might detect persons walking toward the intersection, but because human traffic at the intersection represents limited risk of collision, the system would not display a warning message. On the other hand, if, in this situation, a forklift was approaching the intersection from a different direction, messages should be displayed in the directions of both the walking person and the forklift operator to warn that the forklift and the person were approaching since a collision between a forklift and a person walking could be serious.

The apparatus can be arranged to only display messages for certain combinations of traffic. For example, if one of the items of approaching traffic comprises a substantial amount of metal such as a bicycle, a cart or a forklift, then the apparatus always displays warning messages regardless of the nature of the other traffic. But, in the example, if none of the approaching traffic comprises a substantial amount of metal, the apparatus can be arranged so that no messages are displayed.

Since in most cases the system can distinguish the nature of the traffic, the nature of the traffic approaching can be displayed to the other traffic, whether it is a person, bicycle, forklift, or other traffic.

In every case the use of appropriately designed mirrors also allows those approaching around the periphery of the intersection to see an image of the approaching traffic in the mirror. This is especially true when using the dome mirrors mentioned above. While such mirrors can preclude an image from directly ahead when approaching an intersection, it is the warning and image of traffic approaching from directions other than directly ahead that are needed to identify the possibly unseen traffic. Traffic approaching from directly ahead of one approaching the intersection can in nearly all cases be seen by those approaching. As a note, even traffic approaching from directly ahead can usually be seen in a dome mirror because the mirror is suspended above the intersection and thus offers an image of traffic approaching the intersection from all directions when viewed from below even when not directly beneath.

As noted above, the apparatus can display a variety of warnings. These can be hardwired so that a set of them can be simply displayed based on the nature of the traffic detected, or the apparatus can comprise logic based software to make decisions about the particular message or warning that is displayed. For example, display lighting apparatus can have a word and an arrow to display the nature of traffic and where it is located such as "Forklift→" when a forklift is approaching from the right.

Figure 2:
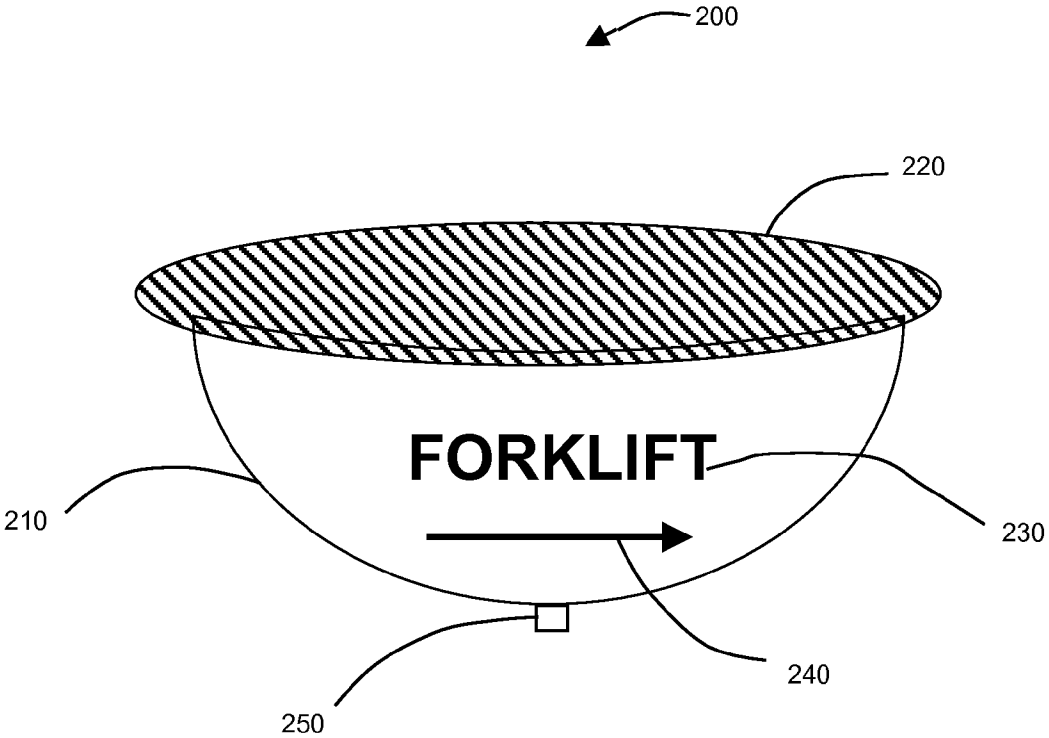
FIG. 2 is a forklift warning.

FIG. 2 shows a dome mirror apparatus 200 that can be used at an intersection with a dome mirror 210 suspended from a ceiling 220 with a forklift warning 230 and an arrow 240 imaged or projected to appear to be on the outside surface of the mirror. Note that FIG. 2 does not show the reflected images of the approaching traffic that would be seen in the mirror.

As mentioned above, the mirror can comprise a single dome of a single curvature or can comprise a combination of surfaces having a plurality of curvatures. Such mirrors other than the common dome mirror in general would be used to satisfy a particular set of needs for a particular situation as it might occur.

In one embodiment the sensing system in communication with the light producing system turns off the warning message or messages when traffic is departing the intersection and no other traffic is approaching the intersection. The function of extinguishing the displayed message can also be accomplished by the use of a timer. However, for safety the timer arrangement must not extinguish the message when additional traffic is approaching the intersection from the direction that is being sensed by the system.

In another embodiment a sound alarm is activated when traffic is sensed near the intersection. This is intended to help draw the attention to the mirror warning apparatus and its reflected and self generated images for added safety.

In another embodiment an indicator such as a pilot light 250, as shown in FIG. 2 is added to the system 200 so that those approaching the intersection know when the apparatus is on and functioning. When a dome mirror 210 is used, this pilot light can be incorporated in the bottom of the inverted dome 210 as shown in FIG. 2 so that it can be seen from any direction of approach. The pilot light 250 can use different signals or colors to indicate the condition of the apparatus. For example, the pilot light when steadily on, could indicate that the apparatus is on and functioning, and when the pilot light is flashing, the apparatus is off and not functioning and that navigation through the intersection should be based on the reflected mirror images.

In yet another embodiment, discrimination reflectors can be placed on specific traffic that will be approaching the intersection to positively identify particular pieces of equipment or classes of equipment that could be passing through the intersection. The use of these discriminators can solve problems that might occur when the sensing system has trouble discriminating between different kinds of traffic. Also, the apparatus can be tied to or can incorporate electronic equipment for gathering data on specific traffic passing through the intersection. For example, a plant manager might want to know how many trips through the intersection a particular piece of equipment makes each day. The discriminator identifying that piece of equipment could gather the data needed.

From another aspect, the warning system can display a message giving the all clear if no traffic is detected. For example, if the system detects no substantially metallic traffic, the system could indicate that there is no metallic traffic and a quick check of the mirror would show any other traffic, such as people walking, that is approaching the intersection. Alternatively, a message indicating that it is safe to pass could be displayed if no dangerous traffic is detected approaching the intersection.

A logic system such as a computer can be incorporated in the apparatus to compose appropriate messages depending on detected traffic and traffic conditions. The logic system could provide messages based on such things as: type of traffic approaching the intersection, size of traffic approaching the intersection, proximity of approaching traffic to the intersection, and speed of traffic approaching the intersection. In addition an electronically produced image of traffic approaching the intersection could be provided via projection on a viewing surface or via an image on a screen visible through the mirror.

Figure 3:
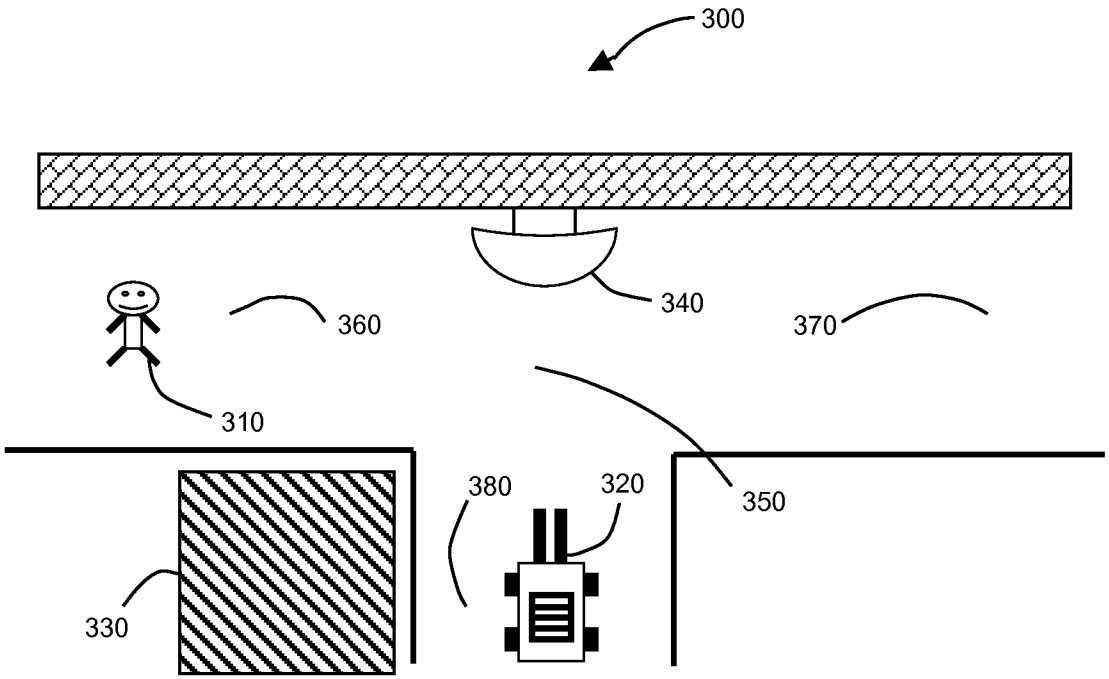
FIG. 3 is a three way intersection.

In another embodiment the apparatus could be placed on a wall instead of being suspended over an intersection. For example, FIG. 3 shows a configuration 300 wherein a person 310 is walking and a powered industrial truck 320 is approaching an intersection 350 shaped like a "T" with obstruction 330 obstructing their view of each other. The apparatus 340 is mounted on the wall opposite one of the pathways leading into the intersection 350. The apparatus can function to warn the forklift 320 operator and the walking person 310 approaching the intersection 350 of each other's presence. The only requirement is that the sensors and the light producing system inside the apparatus 340 be realigned to detect traffic from the three directions of approach 360, 370, 380 to the intersection 350 and to provide messages that are directed appropriately down the three directions of approach 360, 370, 380.

In yet another embodiment the apparatus can be used in advertising and surveillance in various situations. These can be in commercial, surveillance, and other situations where people or equipment move or interact in some way.

In one embodiment the apparatus can be mounted in a retail environment for the purpose of surveillance of areas where retail establishment employees cannot easily see what customers are doing. The apparatus can be loaded with messages that are appropriate for the retail environment and when movement is made in the direction of the apparatus messages appropriate for the situation can be presented using the light producing system. These messages can serve a variety of purposes. They can make the customer take note of the presence of the surveillance mirror; they can be used to draw particular attention to products or services that the retail establishment wants to advertise by creating an appropriate image using the light producing system; and they can alert retail staff to the presence of customers near the apparatus so that the staff can observe customers using the mirror. Of course, the sensors and light producing system will need to be directed appropriately for the particular situation. If a computer resident in the apparatus is used to make decisions about messages, to generate messages or to take data, it will have to be programmed appropriately.

In another embodiment the messages presented through the mirror can also be triggered using external switches and be set to flash or otherwise draw the attention of those in the particular environment in which the apparatus is mounted. For example at a lunch counter or in a bar the apparatus can be mounted so that whenever someone takes a seat a seat switch causes the light producing system to present a flashing message encouraging the customer to buy a particular product such as, "Apple Pie" and at the same time providing an object of visual interest to the customer and a security system for the staff.

Those skilled in the art will realize that this invention is capable of embodiments different from those shown and described. It will be appreciated that the detail of the structure of this apparatus and methodology can be changed in various ways without departing from the scope of this invention. Accordingly, the drawings and detailed description of the preferred embodiments are to be regarded as including such equivalents as do not depart from the scope of the invention.

We claim:

1. An apparatus for seeing and for warning traffic crossing at an intersection comprising:

a partially transparent dome mirror having an outside surface for reflecting incident light and an inside surface for receiving light from inside the dome and passing the light through the mirror;

a light producing system for illuminating the inner surface and transmitting light through the mirror so that the light is visible when viewing the outside surface, the light producing system capable of displaying messages through the mirror for viewing from outside the mirror;

a sensing system for identifying traffic crossing at the intersection, said sensing system having a microwave sensor to identify the nature of approaching objects and traffic, said apparatus differentiating between metal and non-metal objects and traffic and further differentiating between approaching and departing objects and traffic; and the sensing system being in communication with the light producing system, such that the light producing system provides messages visible when viewing the outside surface, the messages provided by said light producing system indicating the direction of approaching traffic and object travel and further indicating information regarding approaching traffic and objects.

2. An apparatus for seeing and for warning traffic crossing at an intersection comprising:

a partially transparent mirror having a first side for reflecting incident light and a second side for receiving and passing light through the mirror;

a light producing system for illuminating the second side, passing light through the mirror so that the light is visible when viewing the first side, the light producing system capable of displaying messages through the mirror;

a sensing system for identifying traffic crossing at the intersection, said sensing system having a microwave sensor to identify the nature of approaching objects and traffic, the sensing system able to distinguish at least two of:

substantially metallic traffic;

substantially non-metallic traffic;

size of approaching traffic; and traffic approaching the mirror from traffic departing the mirror;

in at least one direction for traffic crossing the intersection; and the sensing system comprising a logic system to determine warning messages and being in communication with the light producing system causing the light producing system to display the warning messages to traffic crossing the intersection in other directions, the warning messages visible when viewing the first side of the mirror, the warning messages provided by said light producing system indicating the direction of approaching traffic and object travel and further indicating information regarding approaching traffic and objects.

3. The apparatus of claim 2 where the mirror comprises a curved reflecting surface for displaying reflected images from a plurality of directions.

4. The apparatus of claim 3 where the mirror is substantially in the shape of a spherical dome for displaying images of objects visible in the mirror approaching the intersection from any direction.

5. The apparatus of claim 2 where the mirror comprises a plurality of surfaces having a plurality of curvatures.

6. The apparatus of claim 2 where the sensing system turns off the message when traffic moves away from the mirror and no other traffic is approaching the mirror from the same direction.

7. The apparatus of claim 2 where the mirror is flat.

8. The apparatus of claim 2 wherein the message is turned off according to a preset period of time after the traffic is detected by the sensing system.

9. The apparatus of claim 2 further employing a sound alarm for audibly warning traffic in the vicinity of the intersection.

10. The apparatus of claim 2 where the light system comprises a laser.

11. The apparatus of claim 2 where the light system comprises at least one message board having light emitting diodes.

12. The apparatus of claim 2 where the light producing system comprises a backlit graphical overlay.

13. The apparatus of claim 2 further comprising an indicator to indicate the operational status of the apparatus.

14. The apparatus of claim 2 where discriminators are placed on selected traffic to identify the traffic.

15. The apparatus of claim 2 where the light system displays no message if no moving traffic is detected.

16. The apparatus of claim 2 where a pass message is displayed if no traffic is detected approaching the intersection.

17. The apparatus of claim 2 comprising circuitry that receives data from the sensing system and displays at least one of the following: type; size; proximity to the intersection; speed; and image of traffic approaching the intersection.

18. The apparatus of claim 2 wherein all components comprising the apparatus are mounted in a single unitary package.

19. The apparatus of claim 2 wherein images are projected from the second side of the mirror onto a surface opposite the first side of the mirror.

20. The apparatus of claim 2 wherein the light producing system projects messages on the second side of the mirror that are passed through the partially transparent mirror and appear to be on the first side of the mirror.

21. An apparatus for surveillance and advertising in commercial environments comprising:

a partially transparent dome mirror having a first side for reflecting incident light from outside the dome and a second side for receiving and passing light from inside the dome through the mirror;

a light producing system for illuminating the second side from inside the dome mirror and passing light through the mirror so that the light is visible when viewing the first side, the light producing system capable of displaying images through the mirror for viewing from outside the mirror; and a sensing system for identifying the approach of a customer toward the mirror, said sensing system having a microwave sensor to identify the nature of approaching objects and customer traffic, said apparatus differentiating between metal and non-metal objects and customer traffic and further differentiating between approaching and departing objects and customer traffic, the sensing system being in communication with the light producing system causing the light producing system to provide images visible from outside the mirror, the apparatus capable of sensing objects and customer traffic approaching the mirror and displaying a message through the mirror that can be used for advertising purposes and for alerting purposes while displaying a reflection image visible in the first side of the mirror, the messages provided by said light producing system indicating the direction of approaching object and customer traffic travel and further indicating information regarding approaching objects and customer traffic.

* * * * *